US006220180B1

(12) United States Patent
Janowitz

(10) Patent No.: US 6,220,180 B1
(45) Date of Patent: Apr. 24, 2001

(54) COMPUTER WORKSTATION

(76) Inventor: C. Michael Janowitz, 5 E. 59th St., New York, NY (US) 10022

( * ) Notice: Subject to any disclaimer, the term of this patent is extended or adjusted under 35 U.S.C. 154(b) by 0 days.

(21) Appl. No.: 09/378,109

(22) Filed: Aug. 17, 1999

(51) Int. Cl.[7] ..... A47B 37/00
(52) U.S. Cl. ..... 108/50.01; 108/101; 108/189
(58) Field of Search ..... 108/50.01, 50.02, 108/92, 101, 180, 186, 187, 189, 158.11, 153.1; 211/186, 135; 248/165, 176.1, 917, 918; 312/194, 195, 223.1, 223.3

(56) References Cited

U.S. PATENT DOCUMENTS 1,931,118 * 10/1933 Rowland ..... 248/165 X
4,321,874 * 3/1982 Cenna, III ..... 108/82 X
4,646,655 * 3/1987 Robolin ..... 108/101 X
5,065,873 * 11/1991 Tseng ..... 108/187 X
5,287,815 2/1994 Gross .
5,357,873 * 10/1994 Hilton ..... 108/50.01
5,419,525 * 5/1995 Hilton ..... 108/50.01 X
5,517,928 * 5/1996 Erdman ..... 108/158.11 X
5,623,881 * 4/1997 Huang ..... 108/50.01
5,683,066 * 11/1997 McCann ..... 248/918 X
5,704,298 * 1/1998 Corpuz, Jr. et al. ..... 108/50.01
5,893,469 * 4/1999 Nozawa ..... 248/165 X
5,913,270 * 6/1999 Price ..... 108/101

* cited by examiner

*Primary Examiner*—Peter M. Cuomo
*Assistant Examiner*—Hanh V. Tran
(74) *Attorney, Agent, or Firm*—Cohen, Pontani, Lieberman & Pavane

(57) ABSTRACT

A computer workstation that is easily assembled and provides sufficient space to accommodate a monitor, a keyboard, a mouse, a printer, and a tower central processing unit. The workstation is made of tubular steel to provide increased rigidity and strength and can be configured to as to accommodate both right handed and left handed users.

19 Claims, 4 Drawing Sheets

COMPUTER WORKSTATION

BACKGROUND OF THE INVENTION

1. Field of the Invention

The present invention relates to personal computers, and more particularly, to a computer workstation for supporting and positioning a personal computer and associated peripheral devices.

2. Description of the Related Art

Electronic data processing equipment such as personal computers, communications monitors, workstation terminals, etc., have become standard equipment in modern offices and even in most homes. Many different types of specialize computer workstation furniture have already been developed to support such equipment. However, such furniture is typically very large in construction, with associated high costs and maintenance problems, or relatively lightweight, with limited adjustability, stability and durability.

One drawback in currently available workstations is that they are generally designed to accommodate desktop style central processing units (CPUs). However, recently the computer industry has departed from the original desktop style and has been producing tower style CPUs. Thus, the majority of existing workstations cannot accommodate the tower style CPU, thereby causing the user to place the tower CPU on the floor next to the workstation which does not allow for ready and uniform movement of the workstation. A primarypupose of such known workstation was to configure the CPU with its corresponding peripherals in a neat, organized and functional manner while maintaining elevation of the CPU and peripherals above the floor. However, the evolution of the now more popular tower style CPU is causing the current workstations to become obsolete.

Another drawback of existing workstation arrangements is that they are generally designed to accommodate either right handed or left handed users, and not both. As such, a user is forced to configure a computer and peripheral locations/positions according to the design of the workstation furniture as opposed to the desired comfort of the user.

Therefore, there is a need for a computer workstation which supports a tower-like computer in addition to all peripheral devices while at the same time being configurable to accommodate both right handed and left handed individuals.

SUMMARY OF THE INVENTION

In accordance with an embodiment of the present invention, the computer workstation includes a left side support having a front tubular member, a rear tubular member and at least one cross support extending from the front tubular member to the rear tubular member. A right side support having a front tubular member, a rear tubular member and at least one cross support extending from the front tubular member to the rear tubular member are also provided. A plurality of shelf support rods extend from the left side support to the right side support. The workstation further includes a plurality of shelves releasably connectable to the shelf support rods, with each of the plurality of shelves supporting at least one peripheral computer device. A mouse support is releasably connectable to one of the front tubular members, and a CPU support is connected to one of said left and right side supports and extends outward therefrom, for forming a support for supporting a tower-style CPU.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
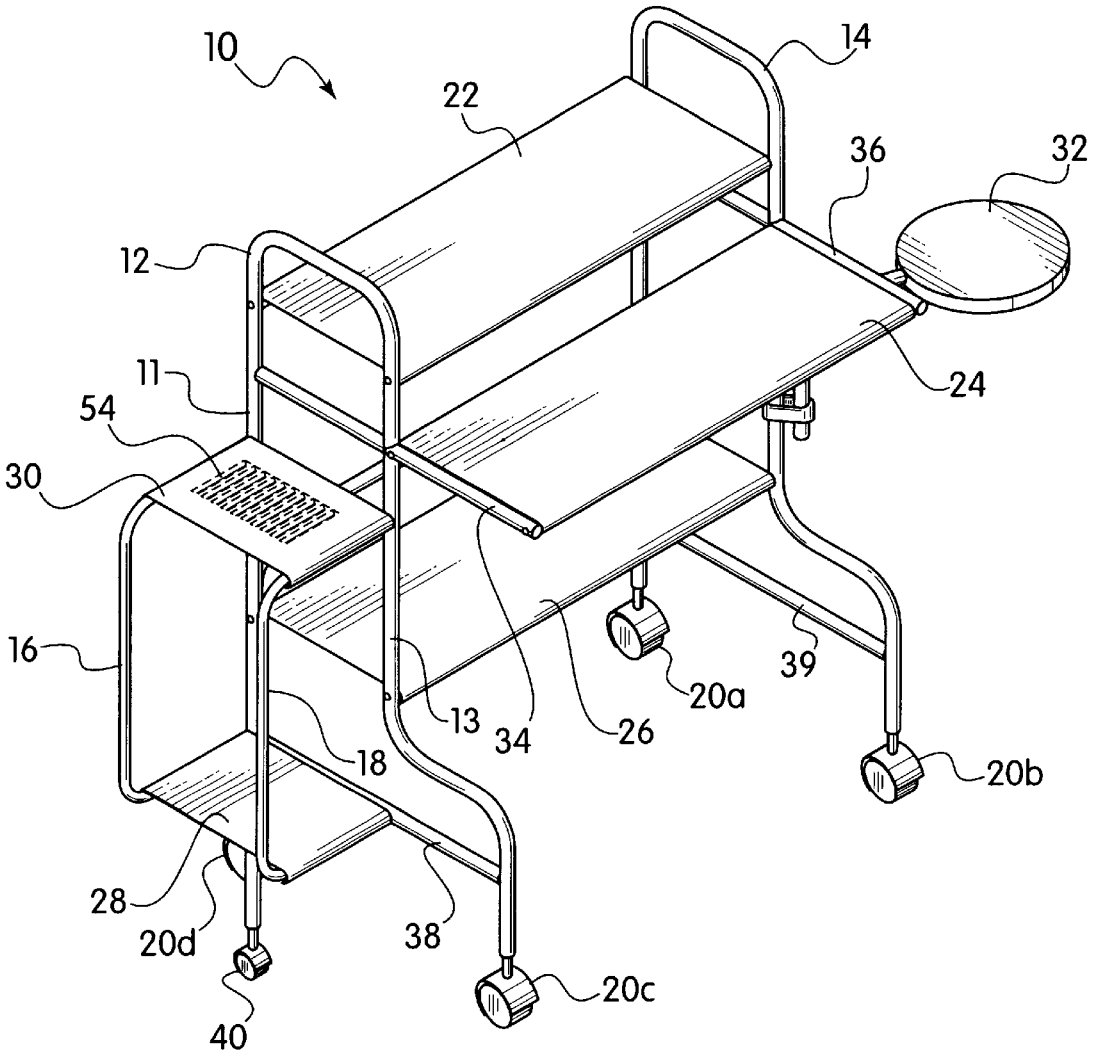
FIG. 1 is a perspective view of the computer workstation according to a first embodiment of the present invention.
Figure 3:
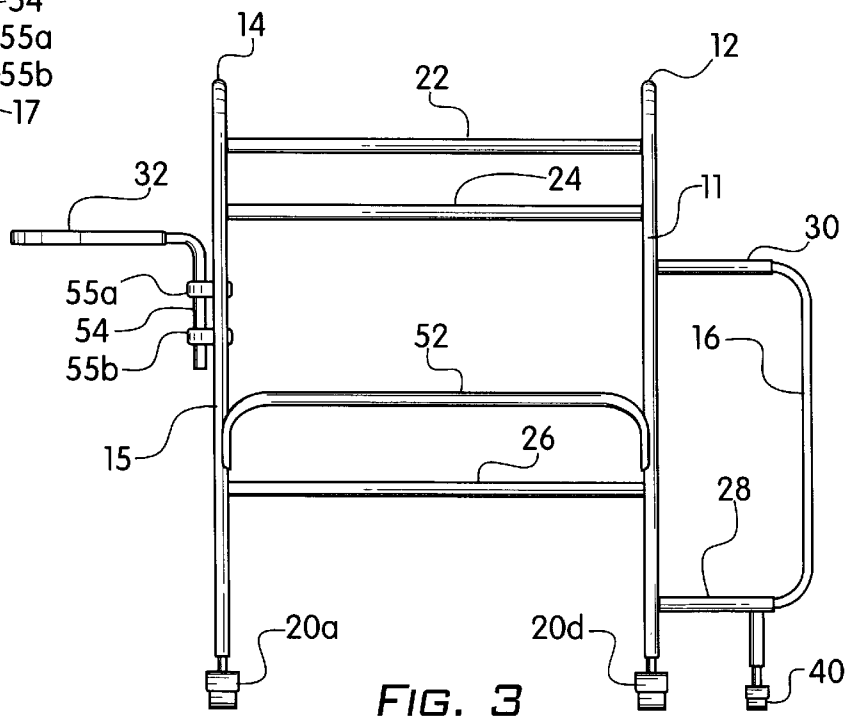
FIG. 3 is a rear view of the computer workstation according to the first embodiment of the invention.

Referring to FIGS. 1–4, there is shown a computer workstation 10 according to an embodiment of the present invention. Workstation 10 has a left side support 12, a right side support 14, a monitor support shelf 22, a keyboard support shelf 24, a lower support shelf 26 a mouse support shelf 32, and a computer (CPU) support shelf 28. Left side support 12 and right side support 14 are constructed of a tubular material, such as, for example, steel. Left side support 12 includes a rear tubular member 11, a front tubular member 13 and cross supports 34 and 38. Right side support 14 includes a rear tubular member 15, a front tubular member 17, and cross supports 36 and 39. Workstation 10 can be stationary or can include wheels 20*a*–20*b* releasably affixed to the four corners defined by left and right side supports 12 and 14, respectively.

Figure 4:
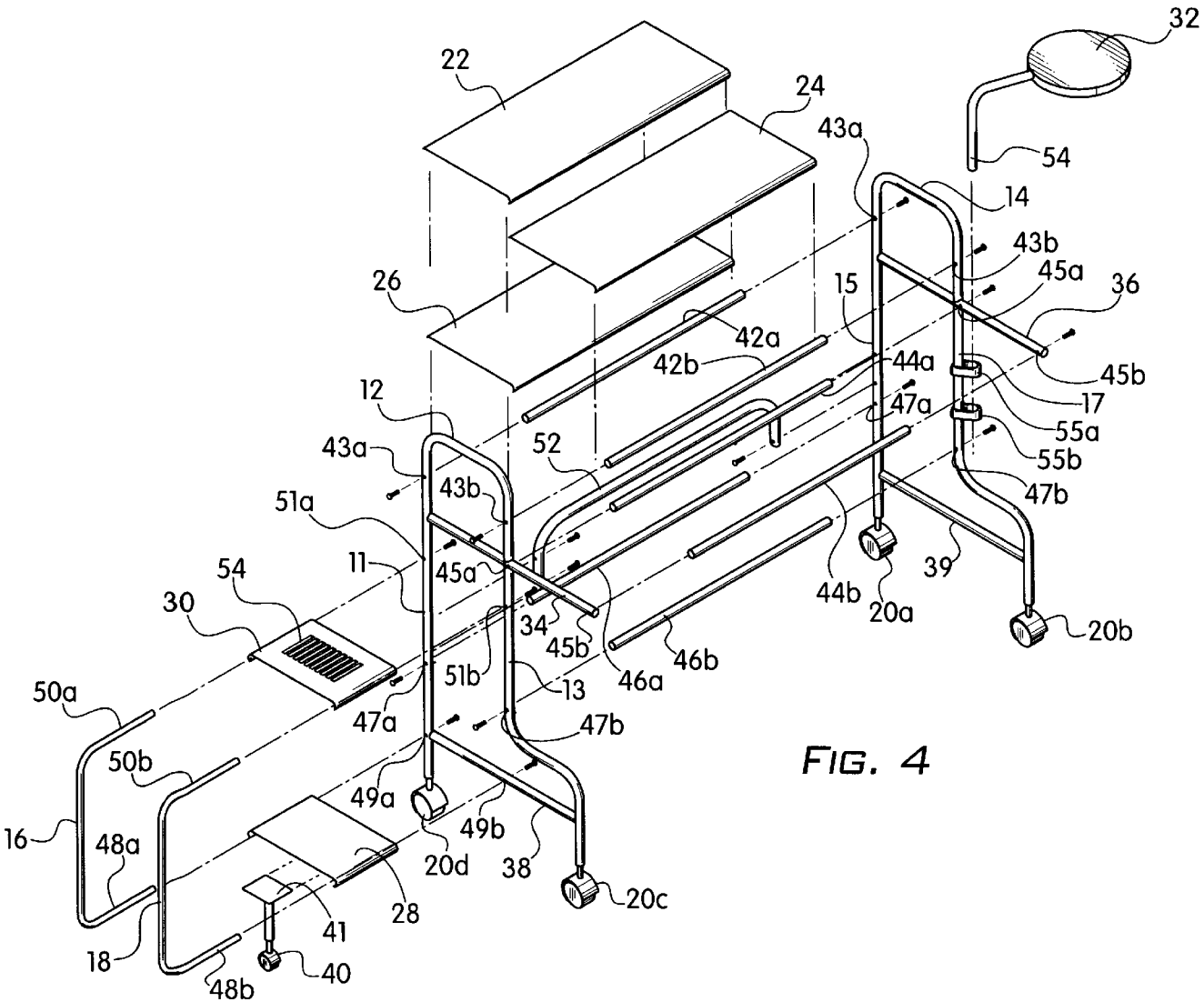
FIG. 4 is an exploded perspective view of the computer workstation according to the first embodiment of the invention.

Left side support 12 and right side support 14 are connected to each other via shelf support rods 42*a*, 42*b*, 44*a*, 44*b*, 46*a*, and 46*b*. As shown in FIG. 4, support rod 42*a* is connected to side 12 using a screw or other fastening device that passes through hole 43*a* in rear tubular member 11 and into rod 42*a*. On the opposing side, a screw or other fastening device passes through a corresponding hole 43*a* in rear tubular member 15 and into rod 42*a*. Support rod 42*b* is connected to front tubular members 13 and 17 via holes 43*b* in a similar fashion. A shelf 22 is then releasably secured onto support rods 42*a* and 42*b* to provide a monitor display support shelf for the user. The secure engagement of shelf 22 with rods 42*a* and 42*b* is described later with reference to FIGS. 5*a* and 5*b*.

Shelf support rods 44*a* and 44*b* are connected to the cross members 34 and 36 so as to provide support for a keyboard shelf 24 receiving the operating keyboard of the computer being held by workstation 10. Each cross member 34 and 36 has corresponding holes 45*a* and 45*b* for receiving screws or other fastening devices and securing rods 44*a* and 44*b*, respectively, transverse to cross members 34 and 36 and side supports 12 and 14. Shelf rod supports 46*a* and 46*b* are connected to the rear and front tubular members 11 and 15, of side supports 12 and 14, respectively. Tubular members 11 and 15 have corresponding holes 47*a* and 47*b* for receiving screws and securing support rods 46*a* and 46*b*, respectively.

According to a first embodiment, workstation 10 includes a tower-style computer (CPU) shelf 28 connected to left side member 12. CPU shelf 28 and the area provided above the same accommodates tower-style computers including full towers and/or mini-towers. The area above shelf 28 is formed from two C-shaped members 16 and 18 each having a lower leg 48*a* and 48*b* and an upper leg 50*a* and 50*b*, respectively. The upper legs 50*a* and 50*b* are connected to the rear tubular member 11 and front tubular member 13, respectively, of side support 12. Rear tubular member 11 includes a hole 51*a* for receiving a screw or other fastening device and securing upper leg 50*a* to side support 12. Front tubular member 13 includes a correspondingly positioned hole 51*b* for receiving a screw or other fastening device and securing upper leg 50*b* to side support 12. The lower leg 48*a* is connected to rear tubular member 11 via a screw through hole 49*a*, and lower leg 48*b* is connected to cross support 38 having a correspondingly positioned hole 49*b* for receiving a screw or other fastening device.

Computer shelf 28 is releasably and securely fitted onto lower legs 48*a* and 48*b*, and includes an additional support wheel 40 having an upper area 41 for contact with the underside of shelf 28. Support wheel 40 supports the additional weight of the tower-style computer and prevents workstation 10 from tipping or having a tendency to tip resulting from the added off-center weight of the tower-style computer sitting on shelf 28.

An additional shelf 30 can be provided above shelf 28 and is supported by upper legs 50*a* and 50*b*. Shelf 30 can provide additional space for resting papers or other items that the user desires, and can be configured with slots 54 for retaining CD-ROM computer discs in a neat and organized manner.

According to the first embodiment, workstation 10 includes a mouse support shelf 32 pivotably attached to front tubular member 17 via compression-like fittings 55*a* and 55*b*. Mouse support shelf 32 includes a support arm 54 passing through each compression fitting 55*a* and 55*b* such that it may positioned according to the user's preference. When not in use, mouse support shelf 32 can be pivoted inward such that it is disposed under keyboard shelf 24 so as to not extend outward beyond right side support 14.

Figure 2:
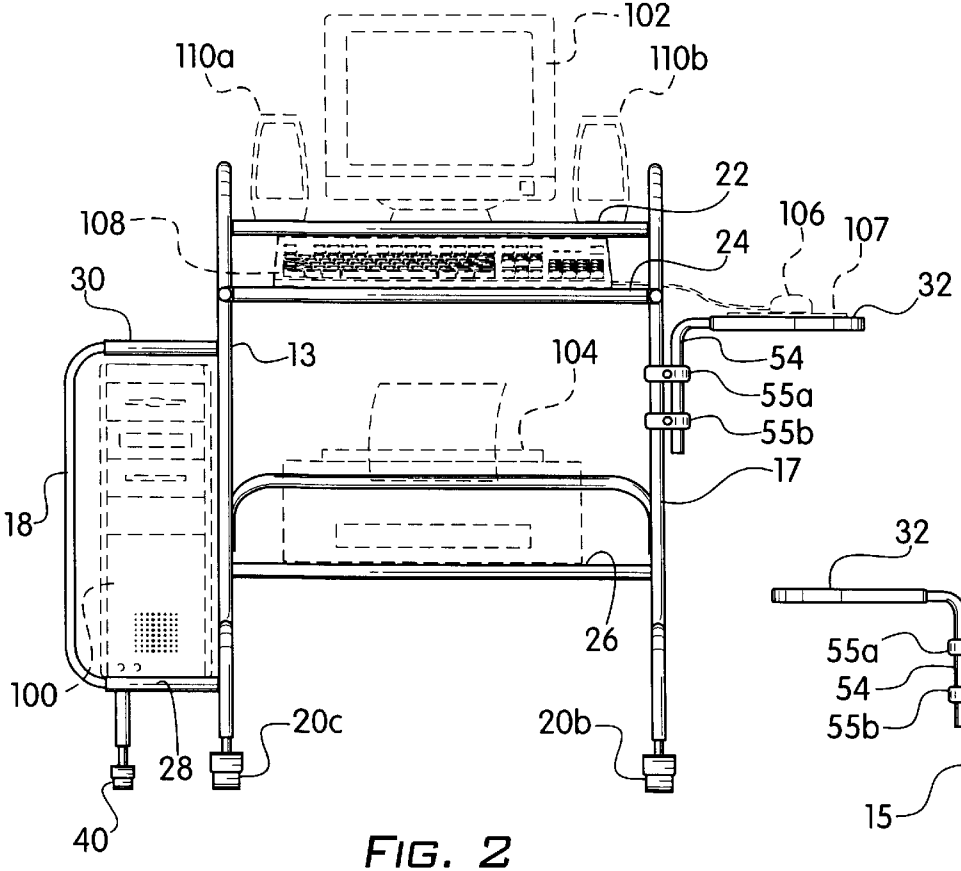
FIG. 2 is a front view of the computer workstation according to the first embodiment of the invention.

FIG. 2 shows an exemplary arrangement of a computer system within workstation 10 where a tower-style computer 100 is supported by CPU shelf 28 and a display monitor is supported by the upper shelf 22. The keyboard 108 is supported by shelf 24 and a printer 104 is supported by shelf 26. A mouse 106 with corresponding mouse pad 107 can be situated on mouse shelf 30. Depending on the user's desire and the size of monitor 102, speakers 110*a* and 110*b* can also be disposed on shelf 22.

A rear cross support 52 (See FIG. 3) is connected to rear tubular members 11 and 15 and provides additional support and stability to workstation 10. Support 52 can have curved ends so as to engage rear tubular members 11 and 15 in a substantially parallel configuration, and thereby provide additional surface area support between tubular members 11 and 15 and cross support 52. Other configurations of cross support 52 can also be implemented without departing from the scope of this disclosure.

Figure 5A:
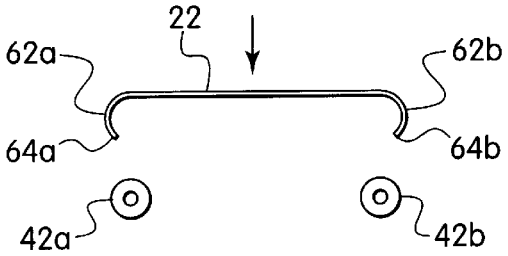
FIG. 5*a* is a side sectional view of a disassembled supporting shelf in the computer workstation according to the present invention.
Figure 5B:
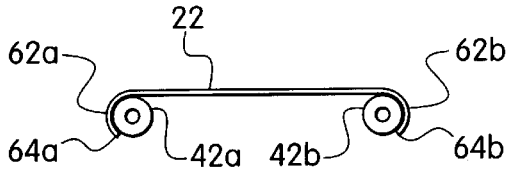
FIG. 5*b* is a side sectional view of the assembled support shelf in the computer workstation according to the invention.

FIGS. 5*a* and 5*b* show, by way of example, how the shelves 22, 24, 26, 28 and 30 engage their respective support rods. For example, shelf 22 includes inwardly curved ends 62*a* and 62*b* having ends 64*a* and 64*b*, respectively. Thus, when support rods 42*a* and 42*b* are connected to side supports 12 and 14, they are positioned such that shelf 22 may be pressed downward (as indicated by the arrow) against rods 42*a* and 42*b* such that ends 64*a* and 64*b* are slightly stressed outward. By continuing to apply downward pressure, rods 42*a* and 42*b* are securely fitted within curved ends 62*a* and 62*b*, and are resiliently retained in this position (as depicted in FIG. 5*b*). In the event that the user desires to remove shelf 22 from its support position on rods 42*a* and 42*b*, an upwardly applied pressure from the underside of the shelf will cause ends 64*a* and 64*b* to flex outward. Once ends 64*a* and 64*b* travel a distance along the circumference of the rods 42*a* and 42*b* substantially equivalent to the radius of the rods, shelf 22 will be released from its fixed positioned on rods 42*a* and 42*b*.

Figure 6:
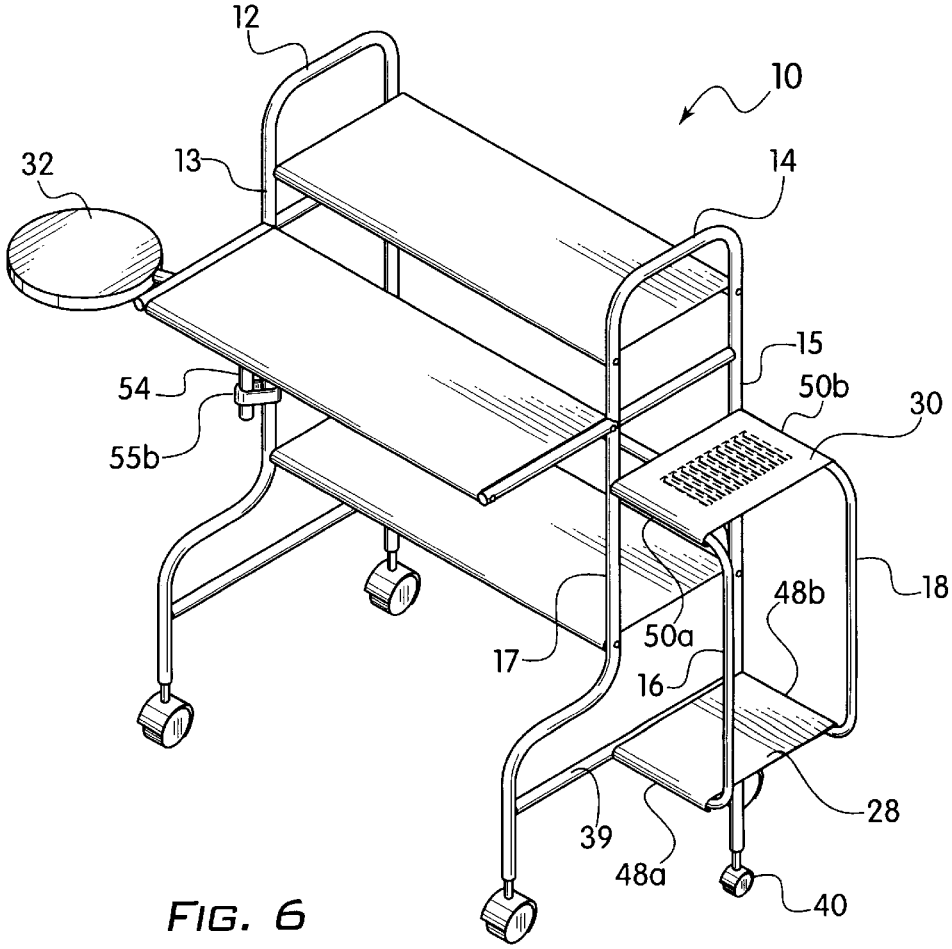
FIG. 6 is a perspective view of a second embodiment of the computer workstation according to the invention.

FIGS. 1–4 show a first embodiment of workstation 10 set up for use with a right handed user (i.e., the mouse shelf 32 on the right side). According to another embodiment of the invention shown in FIG. 6, the computer shelf 28 and corresponding C-shaped supports 16 and 18 can be disposed on right side support 14, and mouse shelf 32 with compression fittings 55*a* and 55*b* can be disposed on the front tubular member 13 of the left side support 12. As shown in FIG. 6, workstation 10 can be easily configured to accommodate both right handed (FIGS. 1–4) and left handed (FIG. 6) users.

While there have been shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention is not limited by the embodiments described above which are presented as examples only but can be modified in various ways within the scope of protection defined by the appended patent claims.

I claim:

1. A computer workstation comprising:

a left side support having a front tubular member, a rear tubular member and at least one cross support extending from said front tubular member to said rear tubular member;

a right side support having a front tubular member, a rear tubular member and at least one cross support extending from said front tubular member to said rear tubular member;

a plurality of shelf support rods extending from said left side support to said right side support;

a plurality of shelves releasably connectable to said shelf support rods, each of said plurality of shelves adapted for supporting at least one peripheral computer device;

a mouse support releasably connectable to one of said front tubular members;

a CPU support capable of being connected to one of said left and right side supports and extending outward therefrom, said CPU support adapted for supporting a tower-style CPU; and at least one compression fitting releasably attached to one of said front tubular members, wherein said mouse support comprises an upper shelf and a mouse support rod having one leg attached to an underside of said upper shelf and another leg releasably connected to one of said front tubular members via said compression fitting.

2. The computer workstation in accordance with claim 1, further comprising:

a plurality of holes in said left side support and a plurality of oppositely positioned holes in said right side support; and a plurality of fasteners for passing through said holes and securing an end of each of said plurality of shelf support rods to said side supports.

3. The computer workstation in accordance with claim 2, wherein two of said plurality of shelf support rods are allocated for each one of said plurality of shelves.

4. The computer workstation in accordance with claim 3, wherein said plurality of shelves comprises at least three shelves for supporting a keyboard, a display monitor and at least one peripheral device connected to the tower-style CPU.

5. The computer workstation in accordance with claim 3, further comprising fastening means for releasably fastening one of said shelves onto a pair of said shelf support rods.

6. The computer workstation in accordance with claim 5, wherein said fastening means comprises inwardly bending opposing edges of each of said plurality of shelves and press fitting said bent opposing edges over said pair of shelf support rods so as to secure each of said plurality of shelves onto the corresponding pair of shelf support rods.

7. The computer workstation in accordance with claim 1, wherein said mouse support is positioned on the one of said front tubular member of the side support opposite said CPU support.

8. The computer workstation in accordance with claim 7, wherein said mouse support is positioned on said right side support and said CPU support is positioned on said left side support to accommodate a right banded user.

9. The computer workstation in accordance with claim 7, wherein said mouse support is positioned on said left side support and said CPU support is positioned on said right side support to accommodate a left handed user.

10. The computer workstation in accordance with claim 1, wherein said CPU support comprises:

at least two C-shad support members each having a lower leg and an upper leg connected to one of said left and right side supports;

a CPU shelf releasably connected to said lower legs of said C-shaped support members; and an upper shelf releasably connected to said upper legs of said C-shaped support members.

11. The computer workstation in accordance with claim 10, comprising a support wheel disposed under said CPU shelf.

12. The computer workstation in accordance with claim 1, further comprising a structural supports rod extending between said left and right side support and being connected to said rear tubular members of said left and right side supports.

13. The computer workstation in accordance with claim 1, further comprising a wheel connected to a bottom of each of said left and right side supports.

14. A computer workstation comprising:

a left side support having a front tubular member, a rear tubular member and at least one cross support extending from said front tubular member to said rear tubular member;

a right side support having a front tubular member, a rear tubular member and at least one cross support extending from said front tubular member to said rear tubular member;

a plurality of shelf support rods extending from said left side support to said right side support;

a plurality of shelves releasably connectable to said shelf support rods, each of said plurality of shelves adapted for supporting at least one peripheral computer device;

a mouse support releasably connectable to one of said front tubular members; and a CPU support capable of being connected to one of said left and right side supports, extending outward therefrom, and adapted for supporting a tower-style CPU, said CPU support having at least two C-shaped support members each having a lower leg and an upper leg connected to one of said left and right side supports, a CPU shelf releasably connected to said lower legs of said C-shaped support members, and an upper shelf releasably connected to said upper legs of said C-shaped support members.

15. The computer workstation in accordance with claim 14 further comprising:

a plurality of holes in said left side support and a plurality of oppositely positioned holes in said right side support; and a plurality of fasteners for passing through said holes and securing an end of each of said plurality of shelf support rods to said side supports.

16. The computer workstation in accordance with claim 15 wherein two of said plurality of shelf support rods are allocated for each one of said plurality of shelves.

17. The computer workstation in accordance with claim 16, wherein said plurality of shelves comprises at least three shelves for supporting a keyboard, a display monitor and at least one peripheral device connected to the tower-style CPU.

18. The computer workstation in accordance with claim 16, further comprising fastening means for releasably fastening one of said shelves onto a pair of said shelf support rods.

19. The computer workstation in accordance with claim 14, further comprising at least one compression fitting releasably attached to one of said front tubular members, wherein said mouse support comprises an upper shelf and a mouse support rod having one leg attached to an underside of said upper shelf and another leg releasably connected to one of said front tubular members via said compression fitting.

* * * * *